US005086567A

United States Patent [19]

Tutsch

[11] Patent Number: 5,086,567

[45] Date of Patent: Feb. 11, 1992

[54] ARCHERY BOW SIGHT RETICLE WITH MULTIPLE FIXED AIMING POINTS

[76] Inventor: Jerald H. Tutsch, 110 S. Midvale Blvd., Madison, Wis. 53705

[21] Appl. No.: 679,645

[22] Filed: Apr. 2, 1991

[51] Int. Cl.[5] ..... F41G 1/46

[52] U.S. Cl. ..... 33/265; 33/241

[58] Field of Search ..... 33/265, 241; 124/87

[56] References Cited

U.S. PATENT DOCUMENTS

| | | | |
|---|---|---|---|
| 821,821 | 5/1906 | Nickerson | 33/243 |
| 1,433,422 | 10/1922 | Spencer | 33/241 |
| 2,610,405 | 9/1952 | Dickinson | 33/243 |
| 3,136,063 | 6/1964 | Stebbins | 33/265 |
| 3,446,561 | 5/1969 | Griffin | 356/147 |
| 3,455,027 | 7/1969 | Perkins | 33/265 |
| 3,477,130 | 11/1969 | Egan | 33/265 |
| 3,811,195 | 5/1974 | Carella | 33/265 |
| 3,854,217 | 12/1974 | Killian | 33/265 |
| 4,016,652 | 4/1977 | Stratman | 33/254 |
| 4,020,560 | 5/1977 | Heck | 33/265 |
| 4,026,032 | 5/1977 | Smith | 33/265 |
| 4,136,462 | 1/1979 | Topel | 33/365 |
| 4,220,983 | 9/1980 | Schroeder | 362/114 |
| 4,263,719 | 4/1981 | Murdoch | 33/297 |
| 4,385,448 | 5/1983 | Burkey | 33/265 |
| 4,535,747 | 8/1985 | Kudlacek | 124/87 |
| 4,584,777 | 4/1986 | Saunders | 33/265 |
| 4,638,565 | 1/1987 | Podany | 33/265 |
| 4,643,160 | 2/1987 | Gray | 124/87 |

OTHER PUBLICATIONS

Popular Science, 3/45, p. 155.

Bowhunters Discount Warehouse Catalog, Spring 1991, (page numbers are given in detailed comments).

Montana Black Gold Sight Brochure, 1991.

*Primary Examiner*—Harry N. Haroian

[57] ABSTRACT

A sight reticle for an archery bow sighting device is disclosed which has a plurality of permanently affixed aiming points spaced at calibrated intervals corresponding to target distances differing by a constant distance. The sight reticle includes a first portion consisting of an attachment screw (1) that attaches at one end to common existing archery bow sighting devices, a second portion (3) attached to the first at the other end of the screw which holds an aiming point carrier (7), and a third portion (7) connected to the second portion that carries multiple aiming points. The topmost aiming point (9) is coaxial with the attachment screw and all aiming points lie on a straight line substantially perpendicular to the long axis of the attachment screw. Rotating the attachment screw about its axis enables the archer to proportionally vary the perceived aiming point intervals in order to adjust the reticle to accommodate any arrow speed.

11 Claims, 1 Drawing Sheet

ARCHERY BOW SIGHT RETICLE WITH MULTIPLE FIXED AIMING POINTS

BACKGROUND OF THE INVENTION

Figure 1:
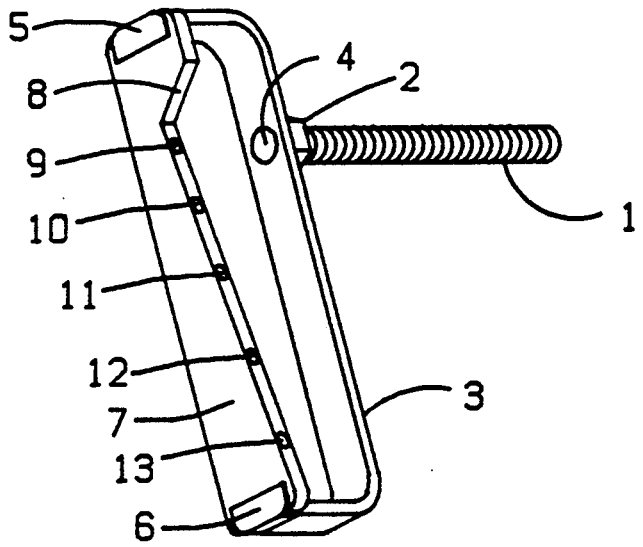

This invention relates to the field of archery bow sights and more particularly to the field of sight reticles for use on archery bow sights. The principle object of the invention is to provide a new type of sight reticle that will allow an archer to easily and economically utilize any existing archery bow sight that accepts an Archery Manufacturers Organization (AMO) standard aiming point pin with 8-32 thread size, as an easy to adjust, easy to use and highly accurate hunting sight with multiple aiming points.

DISCUSSION OF PRIOR ART

It is common for many U.S. archers to engage in two different types of shooting, target shooting and bowhunting. In both types of shooting, sights are used as aids to improve shooting accuracy. There are presently two specialized kinds of archery bow sights available; target sights and hunting sights. Neither of these specialized kinds of sights is acceptable for both styles of shooting. Archers wishing to conveniently and competitively engage in both styles of shooting currently have no alternative but to purchase two separate specialized, and often expensive, sights. Furthermore, each of the two kinds of sights is so difficult to initially adjust to a particular bow that archers, as a matter of convenience, often purchase a separate bow for each sight so that once the sight is adjusted to the bow they may leave the sight on the bow.

Target shooting involves shooting from known distances using sights which have a single finely and easily adjustable aiming point. The single aiming point is affixed to one end of an AMO standard 8-32 screw. The screw in turn threads into an aiming point carrier, commonly called a sight pin block. On a high quality target sight, the vertical and horizontal adjustments of the aiming point carrier are accomplished using a detent mechanism. The detent mechanisms are fine enough to allow professional archers to control the point of impact of an arrow, shot at 20 yards, to within 0.25 inches of the desired location. In practice, 0.25 inches at 20 yards corresponds to 2 to 3 clicks of the detent mechanisms. One detent click corresponds to a motion of the archer's front aiming point of about 0.005 inches, a distance which the archer needs tactile feedback to discern since it is too small to see. In use, the vertical position of the single aiming point carrier on a target sight must be adjusted each time the archer shoots at a target at a new distance. The process of calibrating the sight to a selected set of shooting distances is called "sighting-in."Examples of target sights with detent mechanisms are the Chek-It 9000, U.S. Pat. No. 3,854,217, and the Toxonics DLX-3500, U.S. Pat. No. 4,020,560.

Since it is not reasonable to adjust a bow sight under hunting conditions, because the animal tends to leave the area if the archer is seen moving the bow sight, when hunting, or practicing for hunting, another type of sight is commonly used. These sights have multiple aiming points set at predetermined positions corresponding to targets at various ranges. In most cases, the multiple aiming points consist of several AMO standard 8-32 sight pin screws with a small aiming point sphere on the end of each screw. Examples of hunting sights include U.S. Pat. No. 4,026,032 by J. T. Smith and U.S. Pat. No. 4,535,747 by D. S. Kudlacek. There are other less commonly used types of hunting sights, some using aiming points consisting of adjustable cross-hairs and some using beads that can be moved on a vertical wire. Examples of cross-hair type sights are shown in U.S. Pat. No. 3,136,063 by H. A. Stebbine and U.S. Pat. No. 4,136,462 by K. D. Topel. Examples of bead type sights are shown in U.S. Pat. No. 3,811,195 by R. F. Carella and U.S. Pat. No. 4,385,448 by L. Burkey. When using a hunting sight, the archer selects the aiming point corresponding most closely to the estimated distance to the target. Although the aiming points on hunting sights are adjustable, they are generally neither finely nor easily adjustable, hence they are most often adjusted once during a time consuming sighting-in process, and then remain in a fixed position when the sight is in use in the field. Such sights are called "fixed pin" sights since the aiming points, commonly referred to as pins, remain fixed in position after initial adjustment.

Target sights are not designed to accommodate multiple sight pin carriers, consequently they currently cannot be converted by archers to multi-pin hunting sights. My invention will allow an archer to easily and economically convert any sight that accepts an AMO standard 8-32 sight pin to a fixed pin hunting sight. This includes most target and hunting sights already on the market. Furthermore, adding my sight reticle to a target sight only increases the functionality of the sight. It can still be used as a single aiming point sight, by moving the entire reticle up and down when shooting at different ranges, while using the topmost of the multiple aiming points as the aiming point. This mode of use gives the archer new access to the best features of both kinds of sight, with a single sight.

To sight-in a multi-pin hunting sight, the archer must shoot several arrows at various distances and adjust each sight pin to the proper location. The pins, generally five in number, are most often adjusted vertically by sliding small pin carriers along a track. They are commonly adjusted horizontally by screwing each pin in or out in the horizontal direction. Locking the pins in place is accomplished by tightening small screws and nuts. In most cases, ten small screws and/or nuts must be adjusted by the archer in the process of sighting-in a hunting sight to accomplish the vertical and horizontal adjustment of the five sight pins. The locking screws and nuts are difficult to manipulate because of their small size relative to human fingers. The movable parts also have a tendency to wear out or break because of their size. Various methods of adjusting pin carriers which attempt to minimize the need to manipulate small delicate parts with the fingers have been suggested, see for example U.S. Pat. Nos. 4,136,462 by K. D. Topol and 4,535,747 by D. S. Kudlacek. Each of these sights has a means whereby all sight pins can be adjusted vertically simultaneously and all can be adjusted horizontally simultaneously. The introduction of mechanisms which allow the archer to adjust all pins vertically and/or horizontally at the same time has lead to complicated hunting sights with many parts. Excessive numbers of parts make the sights expensive to manufacture and prone to failure under extensive use.

The small size of the pins and pin carriers is necessitated by the need to be able to move the multiple aiming points close to each other in the archer's field of view when shooting a fast arrow from a modern bow. Many of the current hunting sights cannot easily accommodate the higher arrow velocities brought on by the recent introduction of graphite/fiberglass bow limbs and carbon graphite arrows. When arrow speeds reach 300 feet per second, five aiming points must be precisely positioned in a vertical space of about 0.375 inch. Examples of sights that use different means to bring the aiming pins close to each other in the archer's field of view include; the Chek-It MH-62 double bar sight, the Chek-It SL-300 slanted bar sight, the Toxonics MH-1225 turret sight and the Martin model 537 "bobtail" sight. These sights all have excessive numbers of difficult to adjust small parts.

Although most of the archery bow sight art teaches that multi-pin sights must provide individual pin adjustment mechanisms to accommodate different arrow speeds, there are some bow sights that can be used effectively for hunting that minimize the need to adjust small parts by eliminating individual pin adjustment means. These sights utilize the geometrical principle of proportional aiming point gap adjustment, as embodied for example in gun sight designs by C. A. Murdoch, U.S. Pat. No. 4,263,719, and U. F. Stratman, U.S. Pat. No. 4,016,652. The idea is to fix the aiming points at calibrated spacings and then to provide a means whereby the shooter can proportionally adjust all spacings to accommodate different projectile velocities. Examples of the use of the proportional gap adjustment principle in archery bow sights include U.S. Pat. No. 3,477,130 by T. F. Egan, U.S. Pat. No. 4,584,777 by C. A. Saunders and U.S. Pat. No. 4,643,160 by R. L. Gray.

Like the Murdoch gun sight reticle shown in U.S. Pat. No. 4,263,719, the Egan multiple cross-hair sight, U.S. Pat. No. 3,477,130, and the Saunders multi-pin bow sight, U.S. Pat. No. 4,584,777, rely on a simple rotational means to provide proportional aiming point gap adjustment, however the sight do not provide the fine vertical and horizontal detent adjustment mechanisms available on modern target sights. Another problem with the Saunders sight is that the delicate free standing aiming points need to be protected from damage in the field by the addition of a separate pin guard. Finally, and most significantly, the sight reticle apparatus on the Egan sight, consisting of parts 31 and 32 of the Saunders sight, consisting of parts **50, 51, 53, 54, 55, 56, 57, 60, 64, 64*a*, 65, 66, 67, 68, 69 and 70** in the Saunders sight patent, are not capable of being used on any existing target or hunting sights other than the Egan and Saunders sights respectively.

The Gray sight, though a single pin sight, uses a detent mechanism to implement a means to provide proportional aiming point gap adjustment. A problem with the Gray sight is that the detent mechanism is only discretely scalable and is limited to bow weights of 55 through 80 pounds in 5 pound increments. To accurately accommodate all arrow velocities, which may be varied continuously on modern compound bows by continuously adjusting the draw weight, the detent mechanism would obviously need to be continuously scalable.

Archers shooting outdoors, in particular bowhunters, have a need to shoot accurately under various lighting conditions. Their aiming point must be clearly visible on the target under poor lighting conditions. Several solutions to the aiming point visibility problem have been suggested in the art. Target archers often use lighted scopes, see U.S. Pat. No. 4,638,565 for example. The aiming point in a lighted scope is a small light bulb whose intensity can be controlled by means of a rheostat. Hunting sights using small light-emitting diodes, LEDs, as aiming points are also shown in the art, see for example U.S. Pat. No. 4,220,983 by G. P. Schroeder. Various methods which indirectly shine a small light on aiming points have also been used. Finally, methods involving the use of small amounts of light gathering, refracting or generating materials have been tried. U.S. Pat. No. 4,584,777 by C. A. Saunders shows the use of light gathering material in the aiming point. U.S. Pat. No. 3,446,561 by G. R. Griffin and H. Meyer shows the use of refraction of ambient light to highlight aiming points. Light generating aiming points made of tritium are also available.

None of the proposed solutions to the aiming point visibility problem are entirely satisfactory when applied to archery bow hunting sights. The use of small light bulbs or LEDs requires the use of batteries, which in turn necessitate the use of on/off switches and dimming devices, all of which add to the complexity and cost of the sights while at the same time making them more prone to failure in the field under actual hunting conditions. Furthermore, in some states, artificially lighted bow sights are illegal for hunting since they enable the archer to effectively shoot at times other than during legal hunting hours. Fabricating small individual aiming points out of light gathering, generating or refracting materials has not been entirely satisfactory either, since in order to produce enough light so that the aiming points can be seen under low light conditions, the aiming points must be rather large. When the aiming points become too large, the sight loses its effectiveness as a precision aiming device. The use of tritium in an aiming point makes the aiming point expensive, as well as dangerous, to manufacture. The present invention solves the aiming point visibility problem in a novel way which will become apparent from the description of the preferred embodiment that follows.

There is a need for a device that will enable an archer to utilize any archery bow sight which accepts an AMO standard 8-32 sight pin as an easy to see, easy to use, economical multi-pin fixed pin hunting sight.

Objects and Advantages

Several objects and advantages of the present invention are:

(a) to provide an economical archery bow sight reticle that can be used for hunting style shooting on any existing sight that accepts an AMO standard 8-32 sight pin;

(b) to provide an archery bow sight reticle that can utilize the very fine vertical and horizontal adjustment mechanisms available on existing target sights;

(c) to provide an archery bow sight reticle that adds fixed pin functionality to the existing single-adjustable-pin capability of target sights thereby adding new functionality to target sights;

(d) to provide a multiple aiming point sight reticle which has no moving or detachable parts and consequently no small parts requiring adjustment for use;

(e) to provide a multiple aiming point sight reticle which has small bright aiming points;

(f) to provide a multiple aiming point sight reticle which has aiming points that appear, from the view point of the archer, smaller in height as they are brought closer together in the vertical direction;

(g) to provide a multiple aiming point sight reticle which needs no aiming point guard;
(h) to provide a multiple aiming point sight reticle which can easily accommodate all arrow velocities;
(i) to provide a multiple aiming point sight reticle which can be easily and quickly sighted-in;
(j) to provide a multiple aiming point sight reticle which accommodates simultaneous vertical adjustment of all aiming points;
(k) to provide a multiple aiming point sight reticle which accommodates simultaneous horizontal adjustment of all aiming points;
(l) to provide a multiple aiming point sight reticle which is accurate to the level of the shooting skills of professional archers;
(m) to provide a multiple aiming point sight reticle which is small, light in weight and which can be quickly attached to or detached from most existing target and hunting sights;
(n) to provide a multiple aiming point sight reticle that can easily accommodate several target distances in increments of 10 to 15 units, in units of yards, meters, or paces.
(o) to provide an archery bow sight reticle that can be used legally for bowhunting in all States of the U.S.A;

Other objects and features of this invention will become apparent from the ensuing description.

DRAWING FIGURES

Corresponding reference characters indicate corresponding parts throughout the several views of the drawings.

Figure 2:
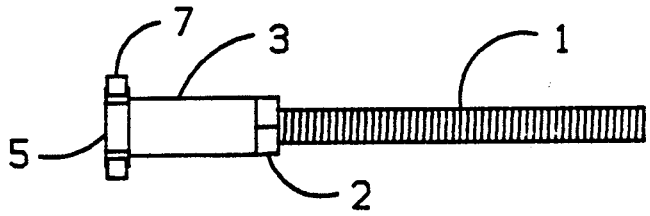

FIG. 1: shows a perspective elevation view of the preferred embodiment of the sight reticle for a right handed archer FIG. 2: shows the top elevation view of the sight reticle shown in FIG. 1

Figure 3:
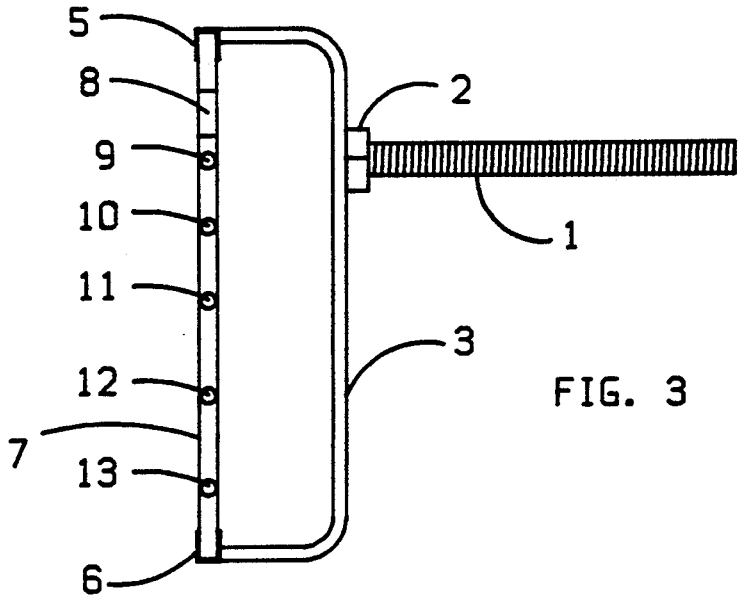

FIG 3: shows the sight reticle shown in FIG. 1 from the archer's point of view while the archer is in the act of shooting

REFERENCE NUMERALS IN DRAWINGS

1. sight reticle attachment screw
2. nut
3. C-shaped frame
4. threaded hole for attachment screw
5. top holder
6. bottom holder
7. aiming point support member
8. viewing edge of aiming point support member
9. first aiming point
10. second aiming point
11. third aiming point
12. fourth aiming point
13. fifth aiming point

DESCRIPTION

The preferred embodiment of the present invention, as it would be implemented for a right handed archer, is illustrated in FIG. 1. The sight attachment screw 1 conforms to the AMO standard and is of such a size so as to thread into sight pin carriers commonly in use on U.S. archery bow sights. The most common thread size for screw 1 is 8-32 . A less common thread size is 10-32. Equivalent metric thread sizes could be provided to accommodate most European sights. The overall length of screw 1 is about 2.00 inches.

The sight attachment screw 1 is screwed into threaded hole 4 in the C-shaped frame 3 and locked in place by nut 2. The attachment screw, nut and C-shaped frame are permanently joined together with solder. The top holder 5 and the bottom holder 6 are symmetric in shape and are soldered to the ends of the C-shaped frame 3. For the right handed archer, aiming point support member 7 slides into the top and bottom holders as shown in FIG. 1 and is glued into position. For a left handed archer, aiming point support member 7 would be rotated front to back before it is affixed to the C-shaped frame 3. The viewing edge of the aiming point support member, 8, is shaped so that aiming point 9 is on the axis of the attachment screw. Aiming points 9, 10, 11, 12 and 13 are collinear and consist of small shallow holes drilled in the edge of the aiming point support member. As determined by testing under controlled conditions, the ratios of the four gap distances between adjacent aiming points 9 and 10, 10 and 11, 11 and 12, 12 and 13 are; 0.899, 0.802, 1.012 and 0.955 inches respectively. An absolute distance of about 1.5 inches between aiming points 9 and 13 will accommodate all arrow velocities of 200 or more feet per second.

The aiming point support member is constructed from fluorescent green or red translucent plastic, commonly called "edge glow" plastic, and has flat polished lateral faces, of width about 0.4 inches. The thickness of the plastic is about 0.09 inches. The diameter of the aiming points is less than the thickness of the plastic so that the aiming points appear to the archer as small dots of light. The edge of the aiming point member facing the archer is painted flat black. After the edge is painted, the shallow aiming point holes are drilled, thus removing some of the black paint and some of the plastic. Ambient light enters the plastic on both lateral faces and exits through the small aiming point holes, causing them to appear as small bright dots. See FIG. 3 for the archer's view of the sight reticle when the archer is in the act of shooting.

Excluding the attachment screw, the outside dimensions of the sight reticle are: width of about 0.65 inches, height of about 2.3 inches, depth of about 0.4 inches.

Operation

The present invention is used by threading the sight reticle attachment screw into the sight pin carrier commonly found on most existing sights. The reticle should first be positioned such that the aiming points are essentially in the plane formed by the bow string and an arrow when the arrow is in shooting position on the string. By simply looking down the arrow shaft, and aligning the shaft with the bow string, the archer can easily bring the reticle to approximately the proper lateral position by screwing the reticle into or out of the pin carrier. On a target sight, fine lateral adjustment is accomplished by using the horizontal detent mechanism on the sight.

Aiming point 9 in FIG. 1 should be the top or short range aiming point. The line formed by the aiming points should parallel the bow string. The attachment screw may be temporarily locked in an approximately correct position using existing locking means on the sight which most often consist of a nut and/or a set screw. Once the reticle is attached to the sight and adjusted to an approximately correct position, the archer shoots several arrows at a target at a first distance, most often a short distance such as 20 yards, and uses the horizontal and vertical adjustment means on the sight to align the first aiming point correctly with the target. The archer then shoots at a longer distance using another aiming point and adjusts the position of the other aiming point by rotating the sight reticle about the axis at the attachment screw so that the arrows strike the target. The second shooting distance might be for example 30 yards and the archer might then use the aiming point indicated by 10 in FIG. 1. Generally the bottom end of the sight reticle would be rotated back toward the archer. Since the first aiming point is on the axis of rotation of the attachment screw, adjusting the angular position of the reticle will leave the first aiming point in the correct position. Once any two aiming points have been properly positioned, the remaining aiming points will be correctly positioned for the corresponding target distances. For example, if the first and second aiming points correspond to 20 and 30 yards respectively, then the other aiming points will correspond to 40, 50 and 60 yards. If the archer is shooting an extremely fast arrow, say in the 300 feet/second range, calibrating the sight reticle to 20, 35, 50, 65 and 80 yards might be preferable.

It should be noted that to sight-in at five equally spaced distances with the sight reticle of this invention, the archer need only adjust the vertical and horizontal position of the first aiming point and the angular position of the reticle itself. This amounts to adjusting the minimal number of parameters, namely three, rather than ten as required by most five pin hunting sights.

It should also be noted that since the aiming points consist of small circular holes, the height of the aiming points will be reduced in size in the same proportion as the pin gaps are reduced in size, from the point of view of the archer, when the sight reticle is rotated back to accommodate higher arrow velocities. Existing bow sights use spherical beads or cylindrical cross-hairs as aiming points, consequently they do not have this feature. With existing sights, as the aiming points are brought closer together in the archer's field of view, they effectively become larger in height relative to the pin gaps, thereby making it more difficult for the archer to see the target clearly relative to the pins and pin gaps.

The present invention is designed to work well under actual hunting conditions, that is, under low ambient light conditions, and on targets with coloration similar to the target background. A typical shooting situation would be where the archer wishes to shoot at a deer at dawn or dusk.

While I have illustrated and described the preferred embodiment of my invention, it is to be understood that changes and modifications in the form, construction, arrangement and combination of the parts of the sight reticle and methods of making and using the same may be substituted for those chosen herein shown and described without departing from the nature and principle of my invention. In particular, while a design that places the short range aiming point on the attachment screw axis is preferable, since this allows the archer to begin the sighting-in process at the shortest range when the sight will be most out of proper adjustment, a design that places some other aiming point on the attachment screw axis will also minimize sighting-in time but the sight might be somewhat less convenient to use.

Summary, Ramifications, and Scope

Accordingly the reader will see that the archery bow sight reticle of this invention can be used by the archer to easily convert most existing archery sights into hunting style sights. Furthermore, the reticle has additional advantages in that:

- it effectively eliminates the need to purchase a specialized hunting sight if the archer already owns a target sight;
- it adds new functionality to a target sight without destroying old functionality;
- it can be economically manufactured in both right and left hand versions;
- it contains no moving or detachable parts;
- it is much easier to sight-in than existing fixed pin sights, requiring the archer to only shoot arrows at two distances;
- it accommodates all arrow velocities;
- it is easy to attach to and detach from existing sights thereby allowing an archer to quickly convert a single bow from a target shooting mode to a hunting mode;
- it is small enough to easily be carried in a pocket;
- it contains no electrical parts yet;
- it provides highly visible aiming points under low light conditions often common while hunting;
- it is of rugged construction;
- it is easy to check visually for proper adjustment;
- it can accommodate target distance increments in any units, for example, yards, meters or paces.

Having thus described the invention, what is claimed and desired to be secured by Letters Patent is:

1. An archery bow sight reticle comprising:

a flat elongated aiming point support member of substantially rectangular cross section with a plurality of fixed aiming points located along a narrow edge, said aiming points to be oriented facing the archer when in use and to be used by the archer to align the arrow with the target when shooting at various distances corresponding to the fixed aiming points, and a frame substantially C-shaped having its opposite ends attached to the ends of said aiming point support member and used to hold said aiming point support member in the proper orientation relative to the archer while shooting.

2. The archery bow sight reticle of claim 1 wherein said flat elongated aiming pint support member is constructed from a translucent light gathering material for the purpose of collecting ambient light from the sides and directing it through the narrow edge facing the archer.

3. The archery bow sight reticle of claim 2 wherein said light gathering material is substantially a cell cast acrylic plastic.

4. The archery bow sight reticle of claim 2 wherein the narrow edge of said aiming point support member which faces the archer is made opaque except at said fixed aiming points.

5. The archery bow sight reticle of claim 4 wherein said fixed aiming points are small shallow holes formed in the narrow edge of said aiming point support member.

6. The archery bow sight reticle of claim 1 wherein two of said fixed aiming points are the edges of a gap in said aiming point support member.

7. An archery bow sight reticle comprising a substantially D-shaped frame with the straight side of said D-shaped frame having a substantially rectangular cross section and serving as a flat elongated aiming point support, with the straight side of said D-shaped frame containing a plurality of fixed aiming points located along a narrow edge, said aiming points to be oriented facing the archer when in use and to be used by the archer to align the arrow with the target when shooting at various distances corresponding to the fixed aiming points.

8. The archery bow sight reticle of claim 7 wherein said D-shaped frame is constructed from a translucent light gathering material for the purpose of collecting ambient light from the sides of the straight side of said D-shaped frame and directing it through the narrow edge of the straight side of said D-shaped frame facing the archer.

9. The archery bow sight reticle of claim 8 wherein said light gathering material is substantially a cell cast acrylic plastic.

10. The archery bow sight reticle of claim 8 wherein the narrow edge of the straight side of said D-shaped frame which faces the archer is made opaque except at said fixed aiming points.

11. The archery bow sight reticle of claim 10 wherein said fixed aiming points are small shallow holes formed in the narrow edge of the straight side of said D-shaped frame.

* * * * *